United States Patent [19]

Power

[11] Patent Number: 4,459,765

[45] Date of Patent: Jul. 17, 1984

[54] HEEL-COUNTER STABILIZER

[75] Inventor: Roy J. Power, Berwyn, Pa.

[73] Assignee: Power-Soler, Inc., Wetumpka, Ala.

[21] Appl. No.: 306,711

[22] Filed: Sep. 29, 1981

[51] Int. Cl.[3] ..... A43B 5/00; A43B 23/17

[52] U.S. Cl. ..... 36/88; 36/114; 36/68; 36/69

[58] Field of Search ..... 36/68, 69, 72 B, 88, 36/114, 128, 129

[56] References Cited

U.S. PATENT DOCUMENTS

| | | | |
|---|---|---|---|
| 3,769,723 | 11/1973 | Masterson et al. | 36/128 |
| 3,918,182 | 11/1975 | Cooper et al. | 36/68 |
| 4,255,876 | 3/1981 | Johnson | 36/129 |
| 4,255,877 | 3/1981 | Bowerman | 36/68 |

OTHER PUBLICATIONS

Runners World, Dec. 1980, back cover Adidas, "Marathon Trainer" Shoe.

*Primary Examiner*—Werner H. Schroeder
*Assistant Examiner*—Steven N. Meyers
*Attorney, Agent, or Firm*—Roland H. Shubert

[57] ABSTRACT

A heel-counter stabilizer is provided for attachment to an athletic shoe having a heel member of resilient material. The stabilizer is adhesively bonded to the exterior of the shoe in a manner which provides both vertical and longitudinal support and bracing between the shoe counter and heel member. The stabilizer is particularly effective to counteract counter "run-over" and heel wear caused by either pronation or supination. It also helps to prevent compression and blowout of the midsole and heel wedge.

7 Claims, 4 Drawing Figures

HEEL-COUNTER STABILIZER

BACKGROUND OF THE INVENTION

This invention relates generally to heel-counter stabilizers for athletic shoes.

More specifically, this invention provides a heel-counter stabilizer for athletic shoes having a resilient heel member to counteract the effects of pronation and supination and to help prevent compression and blow-out of the midsole and heel wedge.

Probably the most common foot problem is that of pronation. The most common causes of foot pronation are generally considered to be either an ankle strain that was not adequately treated or improper shoes.

Foot pronation can often be observed by inspection of the ankle when in a standing position. In a normal foot there is an alignment of the Archilles tendon with the calf of the leg; with pronation there is an inward movement of the ankle and also a flattening of the arch. Internal rotation of the knees is also an indication of foot pronation. When standing in a relaxed manner the knee-cap should be in the center of the knee. If the knee is in internal rotation, indicating pronation, the knee-cap will be toward the midline.

A positive indication of foot pronation is to check a pair of shoes which have been worn for some time. With normal feet, the heel of the shoe should wear toward the back and slightly to one side and the wear on right and left shoes would be similar or balanced. Foot pronation, on the other hand, shows excessive wear on the outer sides of the heel and the shoe counter becomes displaced or "run-over" toward the outer margin of the heel.

Pronation may be alleviated by medical treatment, especially by specialized exercise procedures, and by the use of orthodic support devices within the shoe. One such stabilizer designed for use in an athletic shoe is illustrated by U.S. Pat. No. 4,235,028. There have also been proposed a variety of heel and counter braces or stiffeners which typically comprise a metal plate extending about the heels and counters of shoes or boots. Examples of these devices include those illustrated in U.S. Pat. Nos. 226,771; 1,090,106; 1,448,600 and 1,830,090. All of these devices are meant for use with the traditional leather shoe or boot having a rigid heel member and cannot be adapted to an athletic shoe or modern construction having a resilient heel member.

Another approach to the problem has been the provision of specially reinforced shoe counters. Formed metal supporting strips incorporated between layers of counter material during manufacturer are shown in U.S. Pat. No. 3,425,075. It has also been proposed to provide an external heel counter member of rubber or other resilient material as is shown by U.S. Pat. No. 4,255,877.

Stiff, internal heel counters tend to cause rubbing and blistering especially in athletic use such as running or jumping. Other prior art stabilizing devices are not suitable for modification of athletic shoes.

SUMMARY OF THE INVENTION

A heel-counter stabilizer is provided for athletic shoes of the type having a counter and a resilient heel member separate from the counter. The stabilizer comprises an elongated strip of heat-deformable plastic having a substantial degree of rigidity at ambient temperature. It is positioned about the back of the shoe centered longitudinally along the juncture line of the shoe upper and midsole and extends in a hemispherical arc to a point on either side of the heel approximating the broadest part of the heel. The stabilizer is adhesively bonded to the lower margin of the heel counter and to the upper part of the heel composite.

Hence, it is an object of this invention to provide a means for the stabilization of an athletic shoe counter relative to the shoe heel.

It is another object of this invention to provide means for reducing abnormal heel wear on athletic shoes.

Other objects of this invention will be evident from the following detailed description.

DETAILED DESCRIPTION OF THE INVENTION

Figure 1:
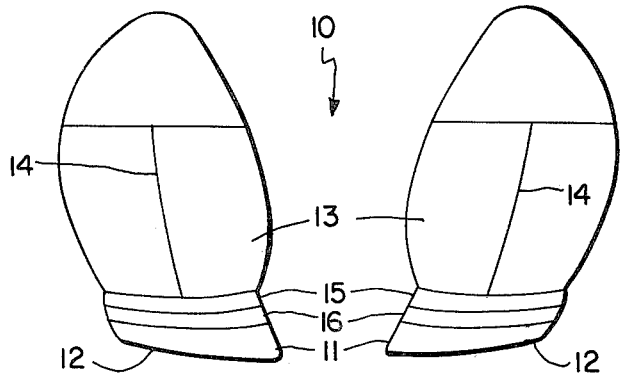
FIG. 1 is a rear elevation view of a pair of athletic shoes showing a particular wear pattern.

Referring now to the drawing, FIG. 1 shows a pair of athletic shoes 10 displaying a wear pattern typical of that caused by pronation. The heels 11 of the shoes display an extreme degree of wear on the outside rear portion 12. Shoe counters 13 are displaced outwardly and counter seams 14 are tilted from their normally vertical position. Midsole 15 and heel wedge 16 also tend to take a permanently set, outwardly distorted attitude. An opposite type of wear pattern is caused by supination. In this case, heel wear is concentrated at the inner rear portion and the shoe counters are displaced inwardly.

In accordance with the present invention, it has been found that provision of an external heel-counter stabilizer will substantially reduce the uneven wear pattern and shoe distortion caused by either pronation or supination. The external stabilizer acts to perform much the same function as an orthodic device fitted inside the shoe. Because the stabilizer prevents the progressive run-over, or sideways distortion, of the heel counter during use, the shoes tend to wear in a more normal fashion thus providing a much higher degree of foot support.

Figure 2:
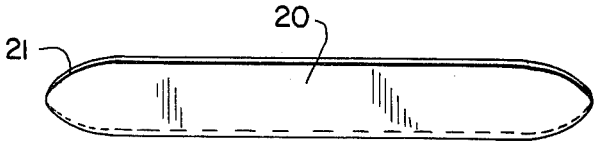
FIG. 2 is a perspective view of the heel-counter stabilizer member.

The stabilizer member itself is shown in perspective view in FIG. 2. Heel-counter stabilizer 20 comprises a strip of heat deformable plastic material having sufficient thickness to display substantial stiffness or rigidity at ambient temperatures. Preferably, the plastic strip forming stabilizer 20 terminates in a arcuate taper at either end 21. Other than at ends 21, the stabilizer member is preferably of constant thickness and width.

A number of thermoplastic polymers or copolymers are suitable for use in fabricating stabilizer member 20. In general, any thermoplastic having a relatively low softening point, on the order of 115° to 200° F., coupled with substantial stiffness or rigidity at ambient temperature is a suitable candidate. It has been found that certain of the ethylene-vinyl acetate copolymers are particularly well suited for this purpose.

Figure 4:
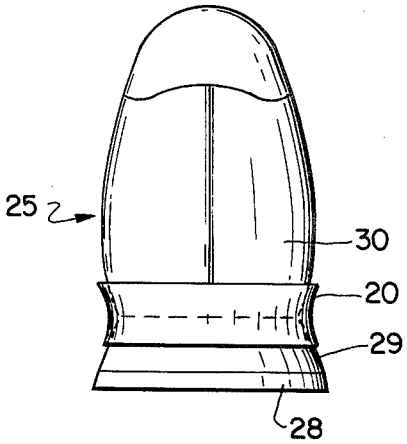
FIG. 4 is a rear view of shoe of FIG. 3.
Figure 3:
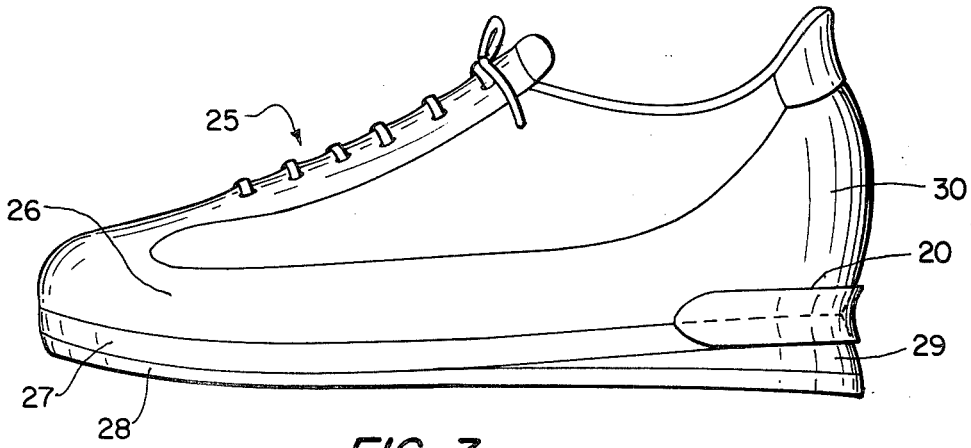
FIG. 3 is a side view of an athletic shoe incorporating a heel-counter stabilizer.

FIGS. 3 and 4 illustrate the heel-counter stabilizer in assembled relationship with an athletic shoe. There is shown in FIG. 3 a side view of an athletic shoe 25 of the type useful in jogging or walking. The shoe is of conventional construction having a shoe upper 26 which may be of leather and synthetic fabric construction. A midsole layer 27 extending the length of shoe upper and the outer sole 28. Midsole layer 27 is fabricated of a soft, resilient rubber so as to provide cushioning while outer sole 28 is of a harder, more wear resistant rubber material. Heel wedge 29 is provided between the midsole layer and the outer sole to raise the heel of the wearer's foot above the bottom surface of the toes.

Stabilizer 20 is fitted in a hemispherical arc about the back of shoe 25 in the manner illustrated. As has been set out previously, stabilizer 20 is fabricated of a thermoplastic having substantial rigidity at ambient temperature. In order to form stabilizer member 20 to the contour of shoe 25, it is heated to its softening point, typically about 150° F. or even lower by placing it in a convection oven, on a warming plate, or by exposing it to radiant energy as through use of a heat lamp or hair dryer. When the stabilizer member is warmed sufficiently to allow workability, it is shaped directly to the shoe and is thereafter bonded to the lower margin of shoe counter 30 and to the upper margin of the heel-sole structure through use of an adhesive.

Sizing of the stabilizer element to the shoe is critical to its proper function as in its positional placement on the shoe. Length of the stabilizer must be such that can wrap around the rear of the shoe to form a hemispherical support with the ends of the stabilizer terminating at approximately the broadest part of the heel. Width of the stabilizer must be sufficient to provide structural bracing between the shoe counter and the heel composite.

At the same time, the bottom edge of the stabilizer must be well above the top of outer sole 28 so as to not interfere with the cushioning effect provided by midsole 28 and heel wedge 29. Thickness must be sufficient to provide substantial rigidity of the stabilizer member. The precise physical dimensions of the stabilizer will of course vary with shoe size. For a size 10 man's shoe, appropriate dimensions of the stabilizer 20 are as follows: Length, about 7 inches; width, about $1\frac{1}{4}$ inches; thickness, about $\frac{1}{8}$ inch. For other shoe sizes, the stabilizer dimensions are scaled accordingly. In general stabilizer dimensions suitable for the broad range of shoe sizes will vary from about 5 inches to about 9 inches in length; from about $\frac{3}{4}$ inch to about $1\frac{1}{2}$ inches in width and from about 3/32 inch to about 5/32 inch in thickness.

The stabilizer is normally positioned in a shoe with its midpoint in approximate alignment with the center of the heel counter or in alignment with the counter seam. It may be advantageously shifted from a centered position more to the inside of the shoe for maximum control of pronation or more to the outside of the shoe for control of supination. It is longitudinally centered along the junction of the shoe upper and the midsole with each end tip of the stabilizer aligned therewith. The stabilizer is adhesively bonded to the shoe using those adhesives compatible with both leather and plastic conventionally used in shoe construction and repair.

The stabilizer may be mounted on new shoes or on older shoes, preferably at the time of re-soling. Because the stabilizer extends only around the lower margin of the heel counter, it does not cause upper counter stiffness with attendant rubbing and blistering of the wearer's feet. At the same time, the stabilizer provides sufficient structural strength and support between the shoe counter and heel to alleviate many of the problems associated with pronation and supination. It also helps to prevent the outward bulging or blowout of the midsole and heel wedge, especially those made of ultralight, highly cushioning material. In another embodiment of the invention, the stabilizer may be pre-formed to fit a particular size and style of shoe. This embodiment is most appropriate when the stabilizer is mounted on new shoes at the point of manufacturer.

While the embodiments described in the specification are considered to be preferred, it is understood that variations and modifications may be made therein within departing from the spirit and scope of the invention.

I claim:

1. In combination, a heel-counter stabilizer and an athletic shoe having an outer sole, a counter and a composite heel member including a midsole and heel wedge both of resilient material and separate from said counter; said stabilizer comprising a heat-deformable plastic strip displaying substantial rigidity at ambient temperature, said strip encircling the back of said counter and said heel member and terminating at the broadest part thereof, the bottom edge of said stabilizer being above the top of said outer sole, and adhesively bonded to the lower margin of said counter and to the upper part of said heel member.

2. The stabilizer-athletic shoe combination of claim 1 in which said stabilizer strip softens to allow shaping at a temperature in the range of about 115° to about 200° F.

3. The stabilizer-athletic shoe combination of claim 1 in which said plastic strip is formed with an arcuate taper at either end and is of uniform width and thickness there between.

4. The stabilizer-athletic shoe combination of claim 1 wherein said plastic strip comprises an ethylene-vinyl acetate copolymer.

5. The stabilizer-athletic shoe combination of claim 1 wherein said stabilizer strip is longitudinally centered along the juncture of the shoe upper and the shoe midsole.

6. The stabilizer-athletic shoe combination of claim 1 herein said stabilizer strip ranges from about 5 to about 9 inches in length, from about $\frac{3}{4}$ inch to about $1\frac{1}{2}$ inches in width and from about 3/32 inch to about 5/32 inch in thickness.

7. The stabilizer-athletic shoe combination of claim 6 wherein the size of said stabilizer strip is scaled according to the size of said shoe.

* * * * *